US007093575B2

(12) United States Patent
Bauman et al.

(10) Patent No.: US 7,093,575 B2
(45) Date of Patent: Aug. 22, 2006

(54) PIN HOUSING SUB-ASSEMBLY FOR AN HYDRAULIC VALVE LIFTER

(75) Inventors: William D. Bauman, Dorr, MI (US); Carl R. Kangas, Sand Lake, MI (US); Fred C. Schouw, Grandville, MI (US); Albert C. Stone, Grandville, MI (US)

(73) Assignee: Delphi Technologies, INC, Troy, MI (US)

( * ) Notice: Subject to any disclaimer, the term of this patent is extended or adjusted under 35 U.S.C. 154(b) by 2 days.

(21) Appl. No.: 10/667,556

(22) Filed: Sep. 22, 2003

(65) Prior Publication Data

US 2005/0061273 A1 Mar. 24, 2005

(51) Int. Cl.
*F01L 1/18* (2006.01)

(52) U.S. Cl. ..... 123/90.45; 123/90.16; 123/90.39; 74/569

(58) Field of Classification Search .. 123/90.39–90.59, 123/90.16, 90.27, 90.31, 90.2; 74/569
See application file for complete search history.

(56) References Cited

U.S. PATENT DOCUMENTS 3,124,115 A * 3/1964 Voorhies ..... 123/90.55
3,301,240 A * 1/1967 Peresada ..... 123/90.51
5,398,648 A 3/1995 Spath et al.
5,431,133 A 7/1995 Spath et al.
5,934,232 A 8/1999 Greene et al.
6,148,780 A * 11/2000 O'Neill et al. ..... 123/90.46
6,164,255 A * 12/2000 Maas et al. ..... 123/90.16
6,196,175 B1 * 3/2001 Church ..... 123/90.16
6,497,207 B1 * 12/2002 Spath et al. ..... 123/90.16
6,606,972 B1 * 8/2003 Wenisch et al. ..... 123/90.17

* cited by examiner

*Primary Examiner*—Thomas Denion
*Assistant Examiner*—Ching Chang
(74) *Attorney, Agent, or Firm*—Patrick M. Griffin

(57) ABSTRACT

An improved pin housing sub-assembly configured for reliable assembly and stability as an intermediate sub-assembly. The length of the plunger return spring is greater than the diameter of the spring well in the pin housing, such that the spring cannot be accidentally installed sideways in the well. During assembly, the non-compressed longer spring places the pushrod seat flush with the end of the pin housing. A shallow annular groove is provided in the inner wall of the pin housing near the outer end thereof, and an expansion ring may be installed therein when the plunger return spring is slightly compressed. The expansion ring holds the sub-assembly together as an intermediate but is displaced by the spring tower in a subsequent assembly step to become the locking ring between the pin housing and the spring tower, as in the prior art.

11 Claims, 2 Drawing Sheets

PIN HOUSING SUB-ASSEMBLY FOR AN HYDRAULIC VALVE LIFTER

TECHNICAL FIELD

The present invention relates to hydraulic valve lifters for use with internal combustion engines; more particularly, to valve deactivation hydraulic lifters for use in push-rod internal combustion engines; and most particularly, to a pin housing sub-assembly for use in such a lifter, including a plunger return spring having a greater length than diameter and a shallow annular groove in the pin housing for a retaining compression ring.

BACKGROUND OF THE INVENTION

Hydraulic valve lifters for internal combustion engines are well known. Some prior art lifters are specially constructed to permit selective deactivation of an engine valve as desired, thereby selectively deactivating the corresponding engine cylinder; see, for example, U.S. Pat. No. 6,497,207 B2, issued Dec. 24, 2002 to Spath et al., the relevant disclosure of which is herein incorporated by reference.

A typical prior art deactivation lifter includes an elongate lifter body having a lower end configured for engaging a cam of an engine. An elongate pin housing slidably disposed within the lifter body includes a radially directed pin bore. A plunger is concentrically disposed within the pin housing. A deactivation pin assembly is disposed within the pin bore and includes two pin members that are biased radially outward relative to each other by a spring therebetween to selectively couple the pin housing to the lifter body when valve activation is desired. The pin members are configured for moving toward each other when the pin chamber is pressurized, thereby retracting the pin members from within the lifter body and decoupling the lifter body from the pin housing when valve deactivation is desired. An elongate spring tower for retaining a lost motion spring has an outer wall concentrically disposed and retained within the outer end of the pin housing. The spring tower typically has slotted tabs or other engagement means and is flexible enough to be pushed downward into the pin housing during assembly until each of the tabs is received within and snaps into or otherwise engages an upper annular groove formed in the inside wall of the pin housing, or into an expansion ring disposable into the annular groove.

The assembly procedure requires that many steps be performed correctly to produce a usable pin housing and spring tower sub-assembly. The procedure is subject to error, however, in that the length of the plunger return spring is less than the diameter of the receiving well in the pin housing, such that the spring may inadvertently and catastrophically turn sideways in the pin housing prior to installation of the plunger sub-assembly against the spring rendering the lifter inoperative or adding significantly to the assembly time of the lifter.

Further, in lifter manufacture, it would be useful to have a pin housing sub-assembly that is self-contained and may be transported or tested or inventoried without falling apart.

Therefore, what is needed in the art is a pin housing sub-assembly wherein the plunger return spring cannot be mis-installed by turning sideways, and wherein the sub-assembly including an expansion ring is held together by the expansion ring itself.

SUMMARY OF THE INVENTION

Briefly described, an improved pin housing sub-assembly is configured for reliable assembly and stability as an intermediate sub-assembly of a valve deactivation hydraulic valve lifter. The length of the plunger return spring is greater than the diameter of the spring well, such that the spring cannot be accidentally installed sideways in the well. The longer spring requires a deeper spring well. However, unlike the prior art sub-assembly wherein a relatively short spring, without compression, allows a retaining ring to be inserted into the pin housing bore adjacent a pushrod seat, in an improved sub-assembly in accordance with the invention, wherein the spring is longer, the pushrod seat now becomes flush with the end of the pin housing because of the longer spring. Therefore, a shallow annular groove is provided in the inner wall of the pin housing near the outer end thereof, and an expansion ring may be installed therein when the plunger return spring is slightly compressed. The ring holds the sub-assembly together as an intermediate but is overcome and displaced by the spring tower in a subsequent assembly step to become the locking ring between the pin housing and the spring tower, as in the prior art.

An advantage of the present invention is that it prevents the plunger return spring from being installed sideways or from tipping over during assembly of the pin housing sub-assembly.

Another advantage of the present invention is that it permits the pin housing sub-assembly to be transported and inventoried as a stable unit, the expansion ring in the new groove holding the assembly together, while still fitting into the prior art assembly process for installing a lost motion spring mechanism wherein a spring tower overcomes and displaces the ring in a subsequent assembly step.

BRIEF DESCRIPTION OF THE DRAWINGS

The present invention will now be described, by way of example, with reference to the accompanying drawings, in which.

DESCRIPTION OF THE PREFERRED EMBODIMENT

The particular benefits and advantages of the invention may be best appreciated by first considering a prior art deactivation lifter.

Figure 1:
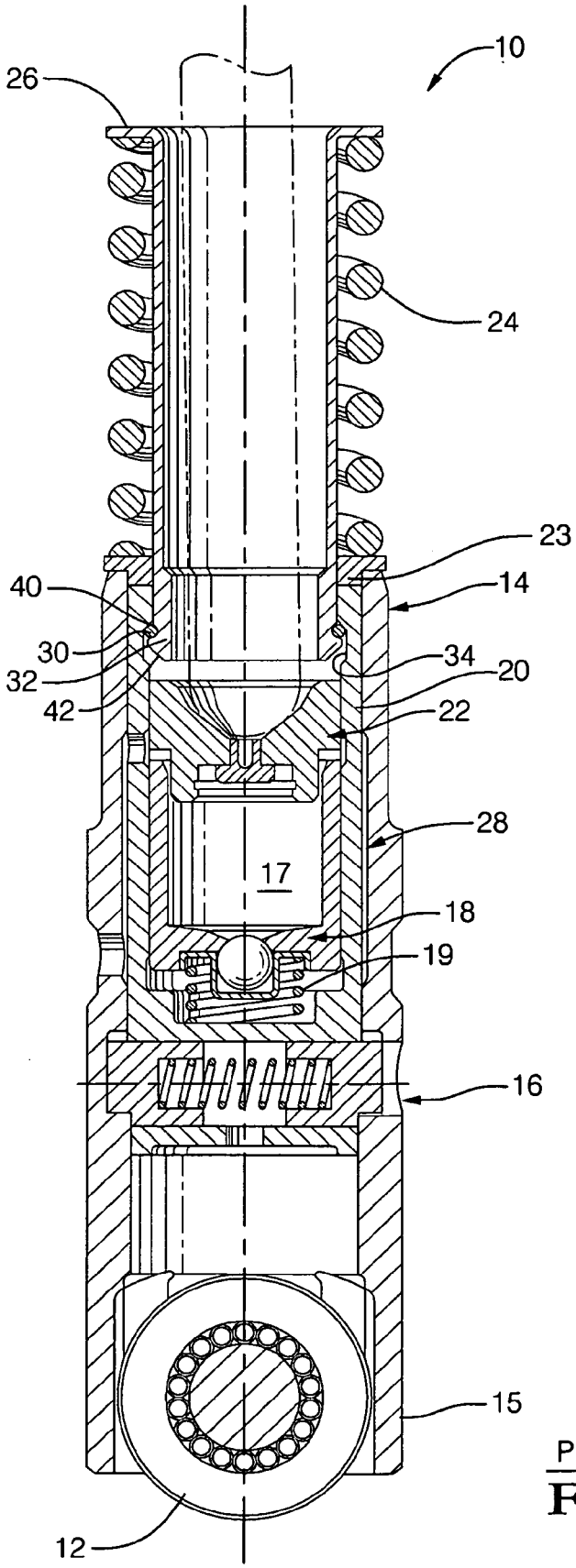
PRIOR ART FIG. 1
FIG. 1 is an axially-sectioned view of a portion of a prior art deactivation roller hydraulic valve lifter.
Figure 2:
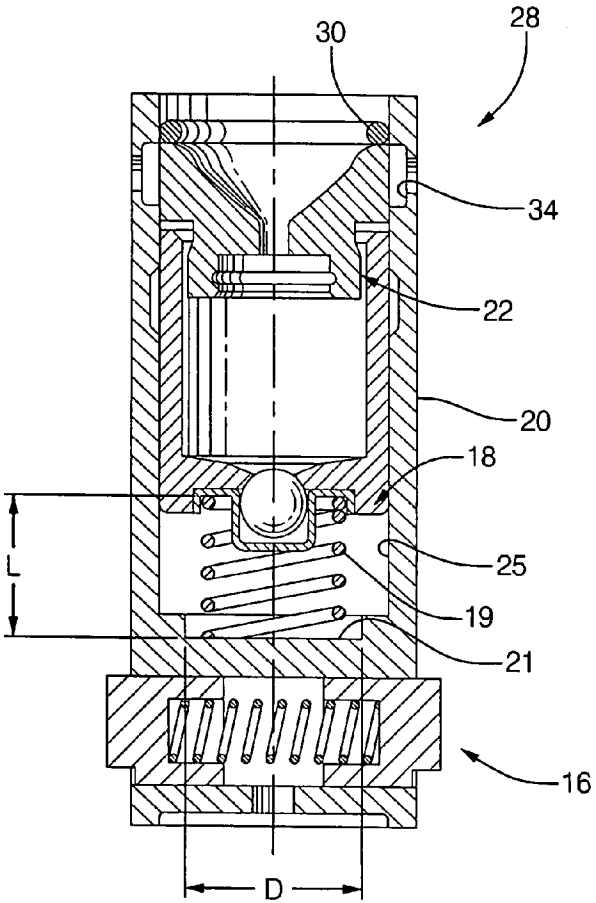
PRIOR ART FIG. 2
FIG. 2 is an axially-sectioned view of a prior art pin housing sub-assembly suitable for use in the prior art lifter shown in FIG. 1.

Referring now to the drawings and particularly to FIGS. 1 and 2, there is shown a prior art embodiment of a deactivation roller hydraulic valve lifter 10. Deactivation roller hydraulic valve lifter (DRHVL) 10 includes roller 12, lifter body 14, deactivation pin sub-assembly 16, plunger sub-assembly 18, pin housing 20, pushrod seat assembly 22, spring seat 23, lost motion spring 24, and spring tower 26.

A pin housing sub-assembly 28 includes pin sub-assembly 16, plunger sub-assembly 18, a plunger return spring 19, seat assembly 22, and expansion ring 30, all disposed within pin housing 20. Pushrod seat assembly 22 is disposed concentrically within pin housing 20 above plunger sub-assembly 18 to form hydraulic chamber 17. Pin housing sub-assembly 28, in turn, is disposed concentrically within lifter body 14.

Roller 12 is associated with lifter body 14. Roller 12 may ride on the cam of an internal combustion engine and be displaced vertically thereby. Roller 12 translates the rotary motion of the cam to vertical motion of lifter body 14. Deactivation pin sub-assembly 16 normally engages lifter body 14, thereby transferring the vertical reciprocation of lifter body 14 to pin housing 20 and, in turn, to plunger sub-assembly 18 and pushrod seat assembly 22. In this engaged position, the vertical reciprocation of DRHVL 10 opens and closes a valve of the internal combustion engine. Deactivation pin sub-assembly 16 disengages to decouple lifter body 14 from pin housing 20 and, in turn, decouples plunger sub-assembly 18 and pin housing 20 from the vertical reciprocation of lifter body 14. Thus, when deactivation pin sub-assembly 16 is in the disengaged position, only lifter body 14 undergoes vertical reciprocation.

Details of prior art lifter construction are fully disclosed in the incorporated reference and need not be repeated here.

The prior art assembly operation for lifter 10 includes the steps of:

a) inserting a plunger return spring 19 into a well 21 in the pin housing bore 25;

b) installing a plunger sub-assembly 18 into the pin housing bore 25 to engage the plunger return spring 19, forming a pin housing intermediate sub-assembly;

c) prefilling and leakdown testing the pin housing intermediate sub-assembly (by means not shown);

d) transferring the intermediate sub-assembly to a pin housing/body assembly machine (not shown);

e) assembling the intermediate sub-assembly into the lifter body 14;

f) installing a pushrod seat sub-assembly 22 into the pin housing bore 25;

g) positioning an expansion ring 30 slidably within bore 25 above pushrod seat sub-assembly 22 to form a lifter body intermediate sub-assembly;

h) transferring the lifter body intermediate sub-assembly to a tower assembly machine (not shown);

i) positioning a lost motion spring seat 23 on the end of pin housing 20;

j) assembling a lost motion spring 24 onto a spring tower 26 having pin housing engagement means 32; and k) extending the spring tower engagement means 32 through the lost motion spring seat 23 and into the pin housing bore 25, collecting the expansion ring 30 on the end of the engagement means 32, compressing the plunger return spring 19 by displacement of the plunger sub-assembly 18 and pushrod seat sub-assembly 22, displacing the expansion ring 30 axially of the pin housing into an annular groove 34 in the pin housing, and forcing the engagement means through the expansion ring 30 to lock the spring and spring tower into the pin housing.

It will be seen that a true pin housing sub-assembly 28, as is shown in FIG. 2, is never actually formed in this assembly sequence, as the pin housing is assembled into the lifter body before the pushrod seat assembly and the expansion ring are added. However, if desired, the sequence of steps could be changed to permit formation of a pin housing sub-assembly 10.

The detailed mechanism by which spring tower 26 is retained in pin housing 20 must be understood in order to fully understand the improvement afforded by the invention. Spring tower 26 is configured to include engagement means 32, preferably comprising a ring groove 40 and beveled bottom edge 42. Expansion ring 30 is shown as a square or rectangular ring member, although ring 30 can be alternately configured, such as, for example, a round retaining ring. As described above, in order to assemble DRHVL 10, spring tower 26 is pushed downward into pin housing 20. As spring tower 26 is inserted into pin housing 20 and pushed axially downward, beveled bottom edge 42 of spring tower 26 contacts ring 30 which is, in turn, displaced axially downward. This downward displacement of ring 30 continues until ring 30 contacts the bottom of annular groove 34, which prevents further downward movement of ring 30. As downward motion of spring tower 26 continues, beveled edge 42 then acts to expand the resiliently deformable ring 30. Thus, ring 30 is resiliently expanded by beveled bottom edge 42 as spring tower 26 is pushed farther downward into pin housing 20. The expanded ring 30 slides over beveled edge 42 of spring tower 26. When ring groove 40 and ring 30 are in axial alignment, ring 30 snaps into ring groove 40. As downward pressure upon spring tower 26 is removed, the action of lost motion spring 24 exerts an upward force on spring tower 26 until ring 30 contacts the top edge of annular groove 34. Thus, expansion ring 30 retains a portion of spring tower 26 within pin housing 20, and determines the axial position of spring tower 26 relative to pin housing 20.

Figure 3:
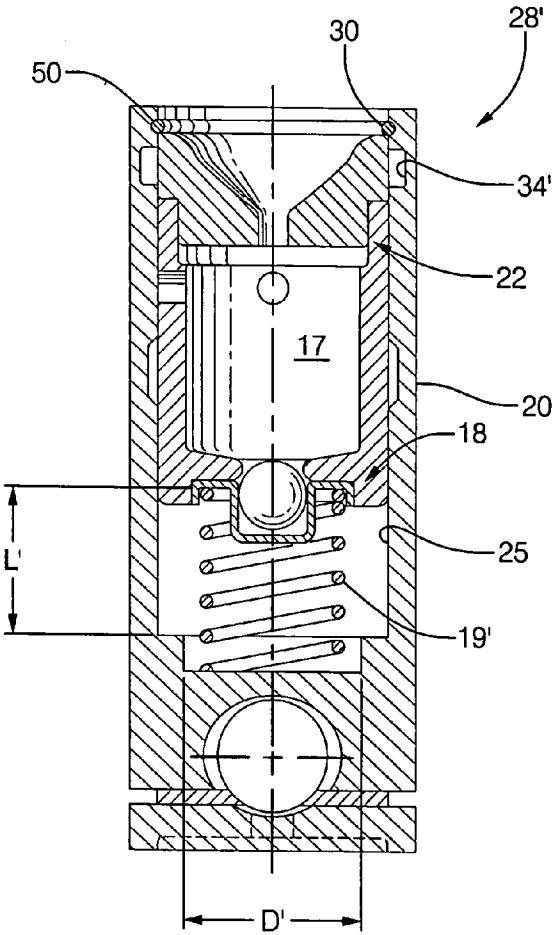
FIG. 3 is an axially-sectioned view of an improved pin housing sub-assembly in accordance with the invention.

Referring now to FIG. 3, an improved pin housing sub-assembly 28', when assembled into a deactivation lifter such as prior art lifter 10, is preferably identical in size and function to prior art pin housing sub-assembly 28. The differences between prior art pin housing sub-assembly 28 and improved pin housing sub-assembly 28' are entirely internal.

The effective aspect ratio of prior art plunger return spring 19 (FIG. 2) is less than 1.0; that is, spring length L is less than diameter D of well 21 (L<D). Thus, during assembly of a prior art lifter, it is possible (and is known) for spring 19 to tip sideways, turning 90° from its intended orientation (not shown), which represents a an assembly failure requiring disassembly and correction.

Contrarily, plunger return spring 19', in accordance with the invention, is formed having length L' greater than diameter D' (L'>D'), such that the spring cannot fit sideways into well 21, thus preventing all such assembly failures. For example, in a prior art lifter, well 21 has a diameter D of 10.7 mm and spring 19 has a non-compressed length of 10.2 mm. Improved spring 19' preferably may have a non-compressed length L' of about 11.5 mm, and preferably diameter D is unchanged (D' =D), such that the aspect ratio is greater than 1.0 (L'/D'=1.07). Both springs meet the load requirements of 10 N at 6.993 mm and 32–36 N at 3.05 mm.

A consequence of employing longer spring 19' is that the space within bore 25 previously available for ring 30 is no longer available without first compressing spring 19' slightly. However, means must then be provided for retaining ring 30 within bore 25 against the force of spring 19'. This is achieved by providing a second annular groove 50 between primary annular groove 34', the eventual tower-locking groove, and the open end of bore 25. Groove 50 is quite shallow, its purpose being to retain ring 30 during the pin housing sub-assembly stage and to release ring 30 when the ring is engaged by spring tower 26 during a subsequent assembly step as in the prior art. The ring is now performing two functions. First, the ring is assembled into groove 50 to resist the spring pressure of the slightly-compressed plunger return spring, preferably about 2 lbs., and to hold the sub-assembly together without interfering with subsequent tower installation into the pin housing. Second, the ring is pushed out of groove 50 by the spring tower and into tower retaining groove 34 to lock the tower and pin housing together for the life of the lifter. Preferably, groove 50 is about 0.004–0.005 inches deep and preferably is chamfered at, for example, about 15° on the inner edge to facilitate ring collection and removal by the spring tower.

It will be seen that the combination of a plunger return spring having an effective aspect ratio greater than 1.0 and a intermediate ring-retaining groove in the pin housing bore provides an improved pin housing sub-assembly wherein the plunger return spring cannot be mis-installed and which can be transported as a stable sub-assembly unit.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A pin housing sub-assembly for use in a valve deactivation hydraulic valve lifter, said pin housing sub-assembly comprising:

a pin housing;

a plunger return spring disposed in a well in said pin housing;

a plunger sub-assembly disposed against said spring;

a pushrod seat assembly spaced apart from said plunger sub-assembly to provide a hydraulic chamber therebetween within said pin housing;

a first groove formed in said pin housing;

a second groove formed in said pin housing, said second groove being positioned between said first groove and an open end of said pin housing; and an expansion member disposed in said second groove, said expansion member adapted to be moved from said second groove and into the first groove so that said pin housing is coupled with a spring tower during the assembly of said hydraulic valve lifter.

2. A pin housing sub-assembly in accordance with claim 1 wherein the depth of said second groove is between 0.004 inches and 0.005 inches.

3. A pin housing sub-assembly in accordance with claim 1 wherein the depth of said first groove is greater than the depth of said second groove.

4. A pin housing sub-assembly in accordance with claim 1 wherein an inner edge of said second groove is chamfered.

5. A pin housing sub-assembly in accordance with claim 4 wherein said inner edge of said second groove is chamfered about 15 degrees.

6. A pin housing sub-assembly in accordance with claim 1 wherein said first groove is annular.

7. A pin housing sub-assembly in accordance with claim 1 wherein said second groove is annular.

8. A pin housing sub-assembly in accordance with claim 1 wherein said spring tower includes a beveled edge that operates to move said expansion member from said second groove into said first groove.

9. A method for assembling a valve deactivation hydraulic valve lifter comprising a pin housing sub-assembly that includes a pin housing, a plunger return spring, a plunger sub-assembly, a pushrod seat assembly, an expansion ring, a first groove formed in the pin housing, and a second annular groove formed in the pin housing and positioned between the first annular groove and an open end of the pin housing, said method comprising:

disposing the plunger return spring in a well in the pin housing;

disposing the plunger sub-assembly against said spring;

spacing the pushrod seat assembly apart from the plunger sub-assembly to provide a hydraulic chamber therebetween within the pin housing; and disposing the expansion ring in the second annular groove thereby retaining the plunger return spring, the plunger sub-assembly, and the pushrod seat assembly within the pin housing to form the assembled pin housing sub-assembly and coupling a spring tower to said pin housing sub-assembly, whereby during coupling the expansion ring is moved out of the second groove and into the first groove.

10. The method in accordance with claim 9 wherein the spring tower includes a beveled edge, and wherein the beveled edge moves the expansion ring out of the second annular groove and into the first annular groove.

11. The method in accordance with claim 10 wherein the spring tower includes a ring groove, and wherein the expansion ring is positioned within both the first annular groove and the ring groove.

* * * * *